US006815897B2

(12) United States Patent
Saleem et al.

(10) Patent No.: US 6,815,897 B2
(45) Date of Patent: Nov. 9, 2004

(54) MAGNETRONS HAVING A COAXIAL LINE OUTPUT WITH UNWANTED MODE ENERGY REDUCTION

(75) Inventors: Kesar Saleem, Essex (GB); Alan Hugh Pickering, Essex (GB); Michael Barry Clive Brady, Essex (GB)

(73) Assignee: E2V Technologies (UK) Ltd., Chelmsford (GB)

( * ) Notice: Subject to any disclaimer, the term of this patent is extended or adjusted under 35 U.S.C. 154(b) by 41 days.

(21) Appl. No.: 09/800,978

(22) Filed: Mar. 8, 2001

(65) Prior Publication Data

US 2001/0052825 A1 Dec. 20, 2001

(30) Foreign Application Priority Data

Mar. 30, 2000 (GB) ..... 0007787

(51) Int. Cl.[7] ..... H01J 23/48; H01J 25/50
(52) U.S. Cl. ..... 315/39.53
(58) Field of Search ..... 315/39.53, 39.51

(56) References Cited

U.S. PATENT DOCUMENTS

| | | | | | |
|---|---|---|---|---|---|
| 2,737,610 | A | * | 3/1956 | Allaire et al. | 315/39.53 X |
| 2,747,137 | A | * | 5/1956 | Tonks | 315/39.53 X |
| 2,906,921 | A | * | 9/1959 | Grardiner | 315/39.69 |
| 3,448,331 | A | * | 6/1969 | Cook | 315/39.53 |

FOREIGN PATENT DOCUMENTS

| | | |
|---|---|---|
| GB | 982806 | 2/1965 |
| GB | 1161385 | 8/1969 |
| GB | 1 600 235 | 10/1981 |

* cited by examiner

*Primary Examiner*—Benny T. Lee
(74) *Attorney, Agent, or Firm*—Donald C. Casey

(57) ABSTRACT

A magnetron has an output comprising a coaxial line 15 which transmits energy from a wanted oscillator mode as a first coaxial waveguide mode and energy from an unwanted oscillator mode as a second cylindrical waveguide mode. Energy in the cylindrical waveguide mode is intercepted by slots 17, 18 in the coaxial line 15 and absorbed by material 10. This enables the modes to be separated. Preferably, the output is taken from the axis of the magnetron and the wanted oscillator mode is the π mode.

20 Claims, 2 Drawing Sheets

MAGNETRONS HAVING A COAXIAL LINE OUTPUT WITH UNWANTED MODE ENERGY REDUCTION

FIELD OF THE INVENTION

This invention relates to magnetrons and more particularly, but not exclusively to magnetrons operating at high power levels.

DESCRIPTION OF THE PRIOR ART

In one known magnetron design, a central cylindrical cathode is surrounded by an anode structure which typically comprises a conductive cylinder supporting a plurality of anode vanes extensive inwardly from its interior surface. During operation, a magnetic field is applied in a direction parallel to the longitudinal axis of the cylindrical structure and, in combination with the electrical field between the cathode and anode acts on electrons emitted by the cathode, resulting in resonances occurring and the generation of r.f. energy. A magnetron is capable of supporting several modes of oscillation depending on coupling between the cavities defined by the anode vanes, giving variations in the output frequency and power. One technique which is used to constrain a magnetron to a particular operating mode is that of strapping. To obtain and maintain the $\pi$ mode of operation, which is usually the mode which is required, alternate anode vanes are connected together by straps. Typically, two straps are located at each end of the anode or in another arrangement, for example, there may be three straps at one end of the anode and none at the other.

In another approach for selecting the mode of oscillation, the magnetron is designed such that the frequency of the $\pi 1$ mode is below cut-off. The magnetron is taken through the cut-off level very quickly so that there is insufficient power generated in the unwanted mode to produce significant oscillation which would otherwise result in power loss from the mode.

However, in some magnetrons, oscillations may occur simultaneously in the desired $\pi$ mode and also in the unwanted $\pi-1$ mode despite the use of strapping, resulting in frequency instability and power being lost from the $\pi$ mode to the $\pi-1$.

SUMMARY OF THE INVENTION

The invention is particularly applicable to magnetrons operating at high power levels, at 1MW or greater, and to magnetrons having a long anode in which it is difficult to achieve the required mode separation. The invention may also be advantageously used in other magnetrons not having these features.

According to the invention, there is provided a magnetron comprising: an anode having resonant cavities and coaxially arranged with a cathode about a longitudinal axis; output means including a coaxial line configured to receive energy in one oscillator mode and transmit it as a coaxial transmission mode and to receive energy in another oscillator mode and transmit it as a cylindrical waveguide mode; and means for at least reducing onward transmission of energy in the cylindrical waveguide mode.

Use of the invention enables energy in the undesired oscillator mode to be removed from the resonant cavities in addition to the energy in the desired mode and subsequently separated from the desired mode energy. Thus, power in the unwanted oscillator mode within the magnetron is reduced, tending to enhance operation in the desired mode and improving frequency stability and power output. The invention is particularly advantageously applied where the anode is long, for example, where the anode has an axial length of greater than hall wavelength ($\lambda/2$) where $\lambda$ is the operating wavelength. For such long anodes, conventional strapping at the ends of the anode may be ineffective in maintaining the required mode separation. In addition, because a long anode allows high power levels to be achieved, in the absence of the invention significant amounts of energy would exist in the unwanted oscillator mode reducing power output in the wanted mode.

The invention may be advantageously employed in magnetrons of different designs, for example, the anode need not be of the vane type. Preferably, power is coupled from the magnetron in an axial direction. This gives a symmetrical output. In one arrangement, a cylindrical wall is located at the end of the anode and fingers are extensive between the wall and alternate anode vanes, to permit the $\pi$ mode to be extracted.

Advantageously, the coaxial line has at least one axially extensive slot through its outer conductor via which energy in the cylindrical waveguide mode is coupled from the coaxial line. In a coaxial transmission mode, the voltage is radial and the current travels in an axial direction whereas in a cylindrical waveguide mode, the currents are circumferential. Thus, the use of an axially extensive slot will not interfere with power transmission in the coaxial waveguide mode but will intercept current in the cylindrical waveguide mode. Advantageously, radiation absorbing material is located at the at least one slot to absorb energy radiated by the slot. Only one slot may be provided but it has been found that four slots located equidistantly around the outer conductor and located at the same position along the axis give particularly good performance. In one embodiment, the absorbing material is porous alumina impregnated with carbon. Longer slots tend to give greater energy absorption and a larger mass of absorbing material may be used to give greater capacity for absorption.

Preferably, the one oscillator mode is the $\pi$ mode and another oscillator mode is the $\pi-1$ mode. Also it is preferred that the coaxial transmission is the TEM mode and the cylindrical waveguide mode is the $TE_{11}$ mode The dimensions of the coaxial line are selected such that it supports both of these waveguide modes. For the $TE_{11}$ mode, the cut off wavelength is equal to multiplied by the sum of the inner conductor diameter and the inner diameter of the outer conductor, the cut off wavelength being equal to or greater than the free space wavelength.

In an advantageous embodiment, there is included at least one axially extensive reflector slit in the output means for reflecting energy from said another oscillator mode back towards the resonant cavity. Thus energy in the cylindrical waveguide mode is coupled back to the resonant cavities. The reflector slits have no effect on the mode as it is transmitted in the TEM mode in which the currents flow axially. However, the $\pi-1$ mode couples to the coaxial line in the $TE_{11}$ mode having circumferential currents which are affected by the reflector slit or slits. By appropriately selecting the length and location of the slits, some of the $TE_{11}$ mode is reflected in a reverse direction along the coaxial line at a phase and magnitude determined by the slit geometries, increasing its coupling to the $\pi-1$ mode in the anode. This gives increased loading, of the $\pi-1$ mode, resulting in more stable operation of the magnetron, permitting it to operate over a wider range of input conditions and to be more tolerant of output and input conditions.

The reflector slit or slits may be in the outer conductor of the coaxial line, the inner conductor or in both. Where the slits are in the inner conductor of the coaxial line, in one preferred arrangement, the slit is extensive through the inner conductor, that is, it extends from one surface to the other. Advantageously, there are two reflector slits in the inner conductor which are both extensive therethrough and which intercept each other. In one embodiment, a reflector slit or slits may he located such that they are located partially or wholly in a region between the resonant cavities and the end of the coaxial line nearest the anode.

A magnetron in accordance with the invention may include a waveguide to which the coaxial line is arranged to deliver energy. The coaxial line may terminate in a T probe although alternative types of termination may be suitable.

Preferably, the coaxial line includes a discontinuity which at least reduces transmission along the coaxial line of energy reflected from the waveguide back towards the anode in a cylindrical mode. Thus, the coaxial line is dimensioned along its length to support both coaxial transmission and cylindrical waveguide modes, but its dimensions change at the termination so as to block transmission in the reverse direction of energy in the cylindrical waveguide mode.

In one magnetron in accordance with the invention, the coaxial line is designed such that both the TEM and the $TE_{11}$ modes, say, can coexist. If the transition from the coaxial line to the waveguide is not perfect, some of the TEM power is reflected by the transition and, due to the transition's asymmetrical shape, is converted into tile $TE_{11}$ mode and transmitted in the reverse direction back towards the magnetron anode along the coaxial line. In a magnetron in which energy absorbing material is arranged to intercept power in the cylindrical mode, reflected output power might also be absorbed in the attenuator material causing the material to heat up and reducing overall efficiency of the magnetron. However, the inclusion of a discontinuity prevents power in the cylindrical mode being transmitted in reverse direction along the coaxial line as it is re-reflected at the discontinuity and transmitted along the output in a forwards direction. Preferably the discontinuity is located between the radiation absorbing material and the transition. Thus, the absorbing material is prevented from being heated by the output power of the magnetron to such an extent that it may give off gas and potentially destroy or reduce the life of the magnetron.

The invention is particularly advantageous for use with high power magnetrons, for example an X-band linac magnetron.

One way in which the invention may be performed is now described by way of example with reference to the accompanying drawings in which:

DETAILED DESCRIPTION OF THE INVENTION

Figure 1:
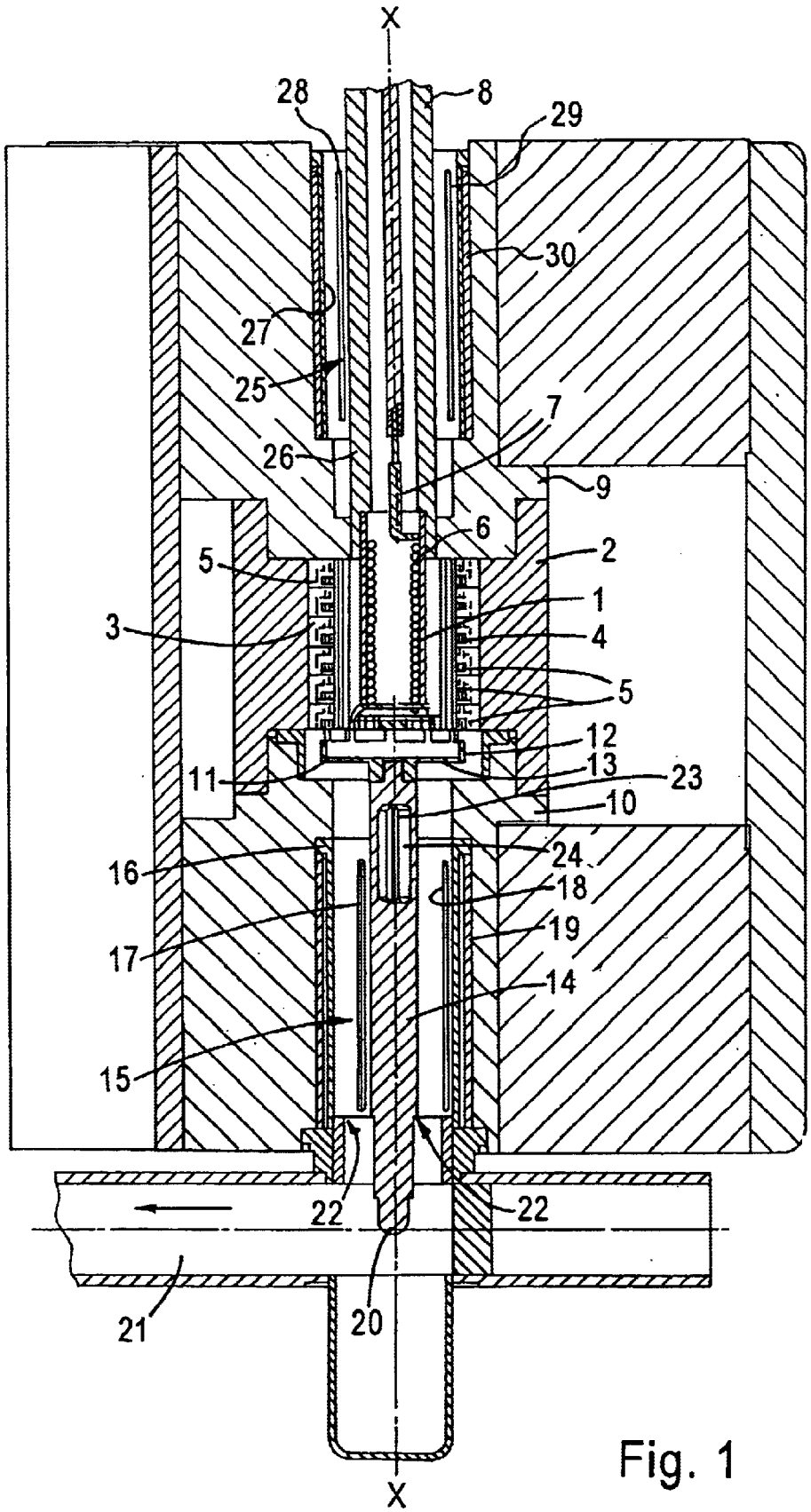
FIG. 1 is a schematic longitudinal section of a magnetron in accordance with the invention.

With reference to FIG. 1, a magnetron includes a cathode 1 coaxially surrounded by a cylindrical anode 2 arranged along longitudinal axis X—X The anode 2 is of the vane type, having a plurality of inwardly projecting vanes, two of which 3 and 4 together define resonant cavities. Straps 5 arc included to improve mode separation and stability and in this particular embodiment are distributed along the axis of (lie anode in accordance with the arrangement described in our co-pending application GB 0030109.5 rather than the conventional arrangement in which straps are only provided at the ends of the anode.

The cathode 1 is in contact with a heater 6 located inside it to which an electrical connection is made via heater lead 7 which is aligned with the axis X—X. The required cathode potential is applied via a tube 8 which surrounds the heater lead 7. Iron pole pieces 9 and 10 are arranged to produce an axial magnetic field in the region between the cathode 1 and anode 2.

The output of the magnetron is coupled in an axial direction from the bottom of the anode 2 as viewed. Alternate anode vanes are connected via fingers, two of which 11 and 12 are shown, to a plate 13. The plate 13 is connected to a conductive member which forms the inner conductor 14 of a coaxial output line 15. The outer conductor 16 of the coaxial line is defined by a copper member which is located in a recess in one of the pole pieces 10. The outer conductor 16 has four equidistant slots, two of which 17 and 18 are shown, which extend through the outer conductor 16. A cylindrical attenuator 19 of radiation absorbing material, which in this case is carbon impregnated alumina, surrounds the outer conductor 16. The end of the coaxial line 15 terminates in a T probe 20 which projects into a rectangular waveguide 21.

Figure 2:
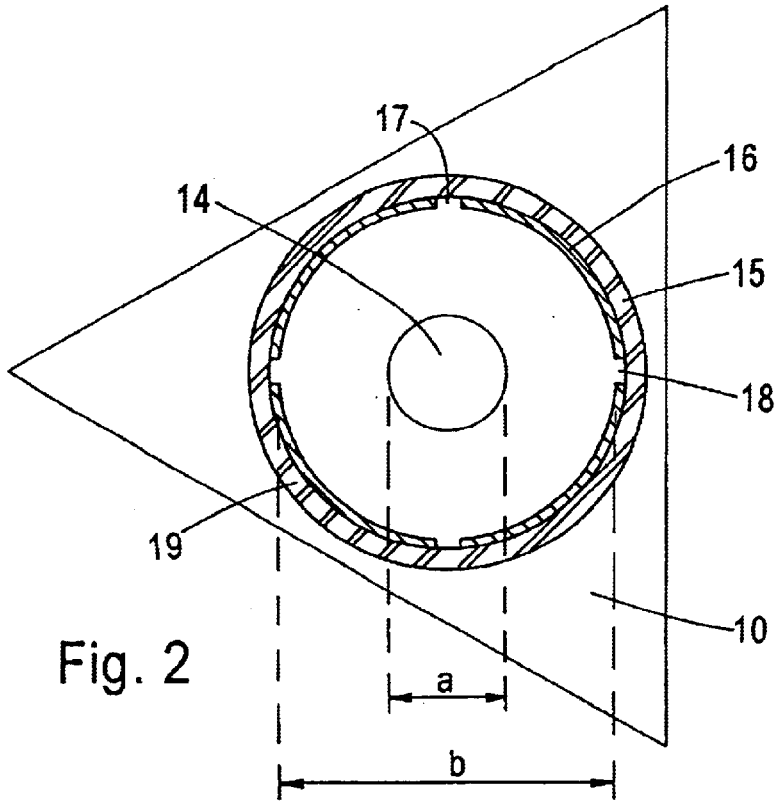
FIG. 2 is a schematic transverse section along the line I—I of FIG. 1.

Further detail of the coaxial output line 15 is shown in FIG. 2. The inner conductor 14 is surrounded by the outer conductor 16 in a coaxial manner. The outer conductor 16 includes slots 17, 18 for providing attenuation as described later. An attenuator 19 of radiation absorbing material surrounds the outer conductor 18 within a pole piece 10. The inner conductor 14 has a diameter 'a' less than the diameter 'b' of the outer conductor 18.

Figure 3:
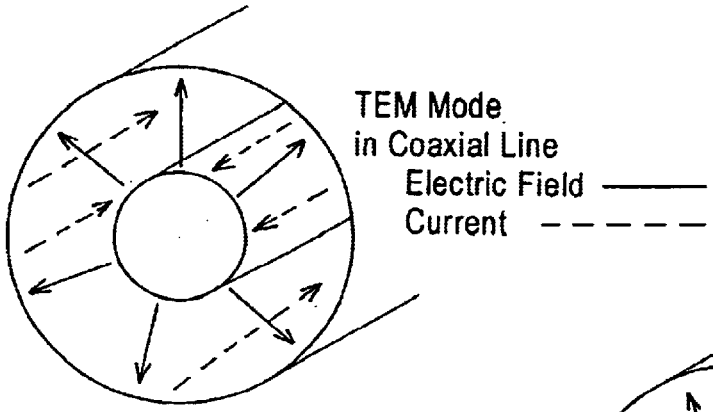
FIGS. 3 and 4 are explanatory diagrams relating to the operation of the magnetron shown in FIG. 1.
Figure 4:
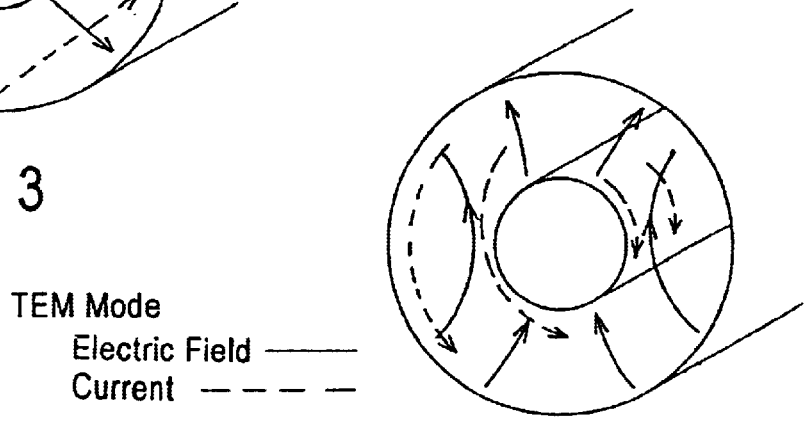

During operation of the magnetron, oscillations are generated in the resonant cavities in the anode and energy is generated in the $\pi$ and $\pi$–1 oscillator modes. Energy in the $\pi$ mode is coupled into the coaxial output line 15 via the fingers 11 and 12, the coaxial line 15 having dimensions such that the mode energy is transmitted along it in the TEM coaxial transmission mode. The coaxial line 15 is dimensioned so that it is also able to support and transmit energy from the $\pi$–1 oscillator mode in a cylindrical waveguide mode, the $TE_{11}$ waveguide mode. FIG. 3 illustrates the TEM mode in which the direction of the currents is shown by the broken lines and that of the electric field by the solid line. FIG. 4 shows the current and electric fields for the $TE_{11}$ mode. As can be seen, in the TEM mode, the currents travel in an axial direction and thus transmission of energy along the coaxial line 15 in the TEM mode is not affected by the presence of the axially extensive slots 17 and 18 in the outer conductor 16. In contrast to this, currents in the $TE_{11}$ mode in FIG. 4 travel in the inner and outer conductors in a circumferential direction. The circumferential currents arc intercepted by the slots 17 and 18, resulting in energy being coupled therethrough and being radiated towards the absorbing material 19. By this mechanism, energy is transmitted along the coaxial line 15 in both the TEM and $TE_{11}$ modes but energy in the $TE_{11}$ mode is absorbed such that the amount transmitted is reduced or it is completely attenuated. Thus the energy coupled into the waveguide 21 by the probe 20 is substantially only that which was generated in the $\pi$ mode oscillation. The output energy is transmitted in the direction shown by the arrow along the waveguide 21. As show FIG. 1

The asymmetric nature of the transition 20 results in some of the TEM mode energy being reflected and re-transmitted along the coaxial line 15 in a reverse direction towards the anode 2, being converted to a $TE_{11}$ mode on reflection. A discontinuity 22, which in this case comprises a reduction in diameter of both the inner conductor and the outer conductor, ensures that energy in the TEM mode that is converted to energy in the $TE_{11}$mode cannot travel beyond the discontinuity 22. Thus it does not impinge on the absorbing material 19 and add to the energy which it must absorb.

The inner conductor 14 also includes two slits 23 and 24 arranged orthogonal to one another and extensive across the diameter of the conductor 14 from one surface to the other. These slits 23 and 24 reflect energy in the $TE_{11}$ mode, energy in the TEM mode being unaffected because of the current directions for this mode are axial. Thus, some of the $TE_{11}$ energy is reflected back from the slits 23 and 24 towards the resonant cavities, increasing the mode loading of the $\pi$–1 mode and increasing the stability of the magnetron output frequency.

In addition to the coaxial line 15 included in the output of the magnetron, a second coaxial line 25 is axially located on the side of the anode to which connection is made to the cathode 1. The inner conductor 26 of the second coaxial line 25 is provided by the tube 8 and the outer conductor 27 is defined by an insert located in a recess in the iron pole piece 9. The outer conductor has four slots, two slots 28 and 29 being shown, arranged around the outer conductor and is surrounded by a cylinder member of radiation absorbing material 30. The dimensions of the second coaxial line 25 are the same as that of the coaxial line 15 in the output but because there is not the directing from the alternate anode vanes, only a very small proportion of energy in the $\pi$ mode is coupled into the second coaxial line 25. However, the second coaxial line dose receive energy from the $\pi$–1 mode which is transmitted along it in the $TE_{11}$ waveguide mode. The energy is coupled via the slots 28 and 29 to the absorbing material 30 where the second coaxial line is absorbed.

Reflectors slits may also be included on the cathode lead side of the magnetron if desired and these reflector slits operate in a similar manner to slits 23 and 24, although for mechanical reasons, in this location the reflector slits would be more conveniently located in the outer conductor of the second coaxial line 25.

What is claimed is:

1. A magnetron comprising: an anode having resonant cavities and coaxially arranged with a cathode about a longitudinal axis; output means including a coaxial line configured to receive energy in one oscillator mode and transmit said one mode as a coaxial transmission mode and to receive energy in another oscillator mode and transmit said another mode as a cylindrical waveguide mode; and means for at least reducing transmission of energy along the coaxial line in the cylindrical waveguide mode wherein the coaxial line is arranged to receive energy coupled in an axial direction substantially parallel to the longitudinal axis from the resonant cavities; wherein the coaxial line has at least one axially extensive slot extending through an outer conductor through which energy in the cylindrical waveguide mode is coupled from the coaxial line.

2. A magnetron as claimed in claim 1 wherein the magnetron is an X-band linac magnetron.

3. A magnetron as claimed in claim 1 wherein the anode has an axial length of greater than ½ $\lambda$ wherein $\lambda$ is the wavelength.

4. A magnetron as claimed in claim 1 and including radiation absorbing material located at said at least one slot to absorb energy radiated by said at least one slot.

5. A magnetron as claimed in claim 4 wherein the absorbing material is porous alumina impregnated with carbon.

6. A magnetron as claimed in any preceding claim and including at least one axially extensive reflector slit in the output means for reflecting energy from said another oscillator mode back towards the resonant cavities.

7. A magnetron as claimed in claim 6 wherein said at least one axially extensive reflector slit is located in an inner conductor of the coaxial line.

8. A magnetron as claimed in claim 7 wherein said at least one reflector slit in said inner conductor is extensive therethrough.

9. A magnetron as claimed in claim 8 wherein the at least one axially extensive reflector slit comprises two reflector slits in the inner conductor which are extensive therethrough and intersect.

10. A magnetron as claimed in claim 6 wherein the at least one coaxially extensive reflector slit is located in the surface of an outer conductor of the coaxial line.

11. A magnetron as claimed in claim 6 wherein the at least one coaxially extensive reflector slit is located partially or wholly in a region between the resonant cavities and the end of the coaxial line nearest the anode.

12. A magnetron as claimed in claim 1 wherein the coaxial line is arranged to deliver energy to a waveguide.

13. A magnetron as claimed in claim 12 wherein the coaxial line terminates in a T-probe.

14. A magnetron as claimed in claim 12 wherein the coaxial line includes a discontinuity which reduces transmission along the coaxial line of energy reflected from the waveguide back towards the anode in a cylindrical waveguide mode.

15. A magnetron comprising: an anode having resonant cavities and coaxially arranged with a cathode about a longitudinal axis; output means including a coaxial line configured to receive energy in one oscillator mode and transmit said one mode as a coaxial transmission mode and to receive energy in another oscillator mode and transmit said another mode as a cylindrical waveguide mode; and means for at least reducing transmission of energy along the coaxial line in the cylindrical waveguide mode wherein the coaxial line is arranged to receive energy coupled in an axial direction substantially parallel to the longitudinal axis from the resonant cavities said magnetron further including a second coaxial line arranged to receive energy in said another oscillator mode coupled in the axial direction from the end of the anode where a cathode lead is located and transmit the energy as a cylindrical waveguide mode.

16. A magnetron as claimed in claim 15 and including at least one axially extensive slot through which energy is coupled from the second coaxial line.

17. A magnetron as claimed in claim 16 wherein said at least one slot is located in an outer conductor of the second coaxial line.

18. A magnetron as claimed in claim 17 and including radiation absorbing material arranged to receive energy coupled from the second coaxial line through said at least one slot.

19. A magnetron as claimed in claim 18 wherein said absorbing material is porous alumina impregnated with carbon.

20. A magnetron as claimed in any one of claims 15 to 19 and included at least extensive reflector slit in the second coaxial line for reflecting energy from said another oscillator mode back towards the resonant cavities.

* * * * *